United States Patent [19]

Baugh et al.

[11] 4,345,649

[45] Aug. 24, 1982

[54] WELL PACKER

[75] Inventors: John L. Baugh; James W. Montgomery, both of Houston, Tex.

[73] Assignee: Hughes Tool Company, Houston, Tex.

[21] Appl. No.: 184,674

[22] Filed: Sep. 5, 1980

[51] Int. Cl.[3] ..... E21B 33/128; E21B 33/129

[52] U.S. Cl. ..... 166/120; 166/217; 166/387

[58] Field of Search ..... 166/120, 122, 123, 124, 166/125, 212, 217, 387

[56] References Cited

U.S. PATENT DOCUMENTS

| | | | |
|---|---|---|---|
| 3,011,555 | 12/1961 | Clark, Jr. | 166/122 |
| 3,142,338 | 7/1964 | Brown | 166/120 |
| 3,391,740 | 7/1968 | Edwards, Jr. | 166/120 |
| 3,659,647 | 5/1972 | Brown | 166/120 |
| 3,749,166 | 7/1973 | Young | 166/123 |
| 4,258,787 | 3/1981 | Amancharla | 166/120 |

OTHER PUBLICATIONS

Composite Catalog of Oil Field Equipment and Services, 1970–1971, p. 819, (Brown Oil Tools, Inc. Brochure).

Composite Catalog of Oil Field Equipment and Services, 1974–1975, pp. 758–759, (Brown Oil Tools, Inc. Brochure).

Composite Catalog of Oil Field Equipment and Services, 1976–1977, p. 868, (Brown Oil Tools, Inc. Brochure).

Composite Catalog of Oil Field Equipment and Services, 1978–1979, pp. 1037 and 1038, (Brown Oil Tools Brochure).

Composite Catalog of Oil Field Equipment and Services, 1980–1981, pp. 1161 and 1162, (Brown Oil Tools, Inc. Brochure).

*Primary Examiner*—Stephen J. Novosad

*Attorney, Agent, or Firm*—Robert A. Felsman; Charles D. Gunter, Jr.

[57] ABSTRACT

Disclosed is a well packer for releasable setting within a well conduit, including a seal assembly for sealing the packer to the conduit and an anchor assembly for anchoring the packer to the conduit. The packer is set in stages by hydraulic pressure. The seal assembly is extended, and locked, in sealing configuration; the anchor assembly is then set, and locked, in gripping engagement with the conduit. The packer is released by longitudinal movement of a central mandrel relative to the seal and anchoring assemblies. The release of the packer also occurs in stages, with the seal assembly unlocked and released from its set configuration followed by like operations relative to the anchor assembly. A hold-down system prevents premature release of the packer by securing the mandrel against such relative longitudinal movement.

7 Claims, 18 Drawing Figures

FIG. 3A
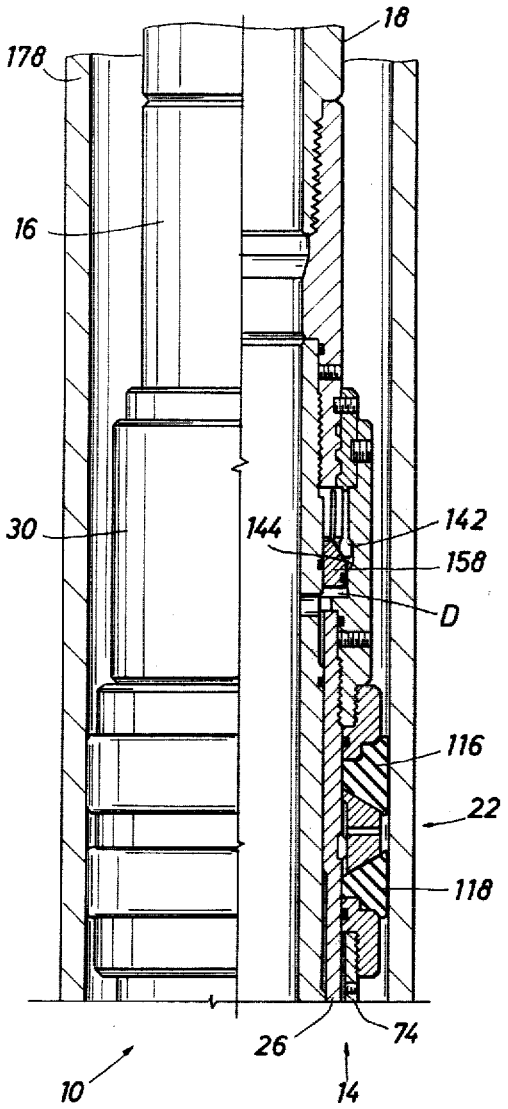
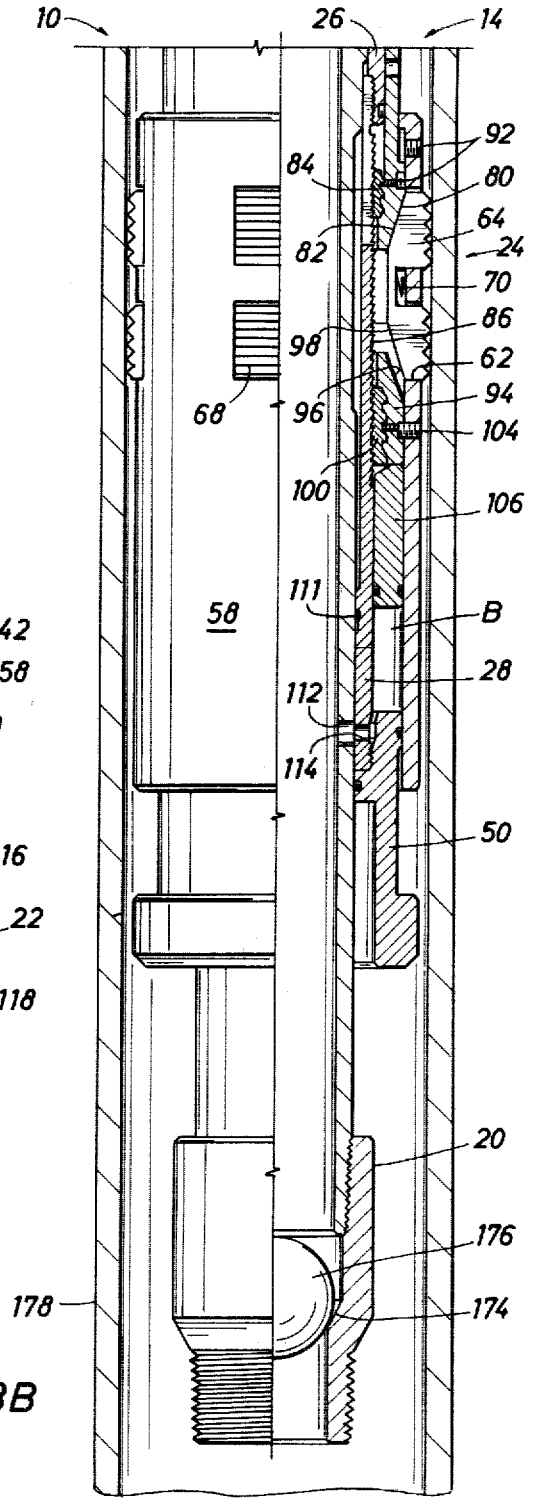
FIG. 3B

FIG. 4A
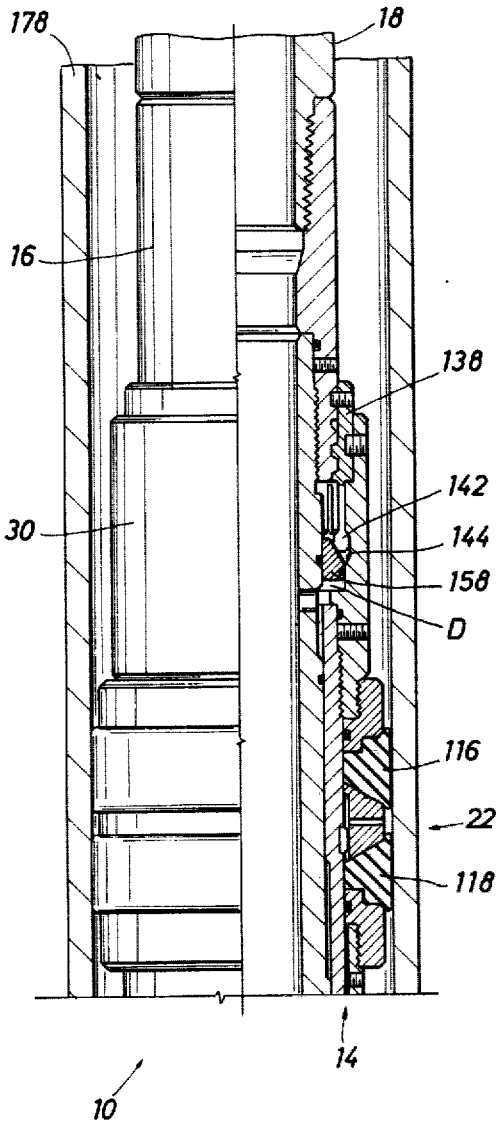
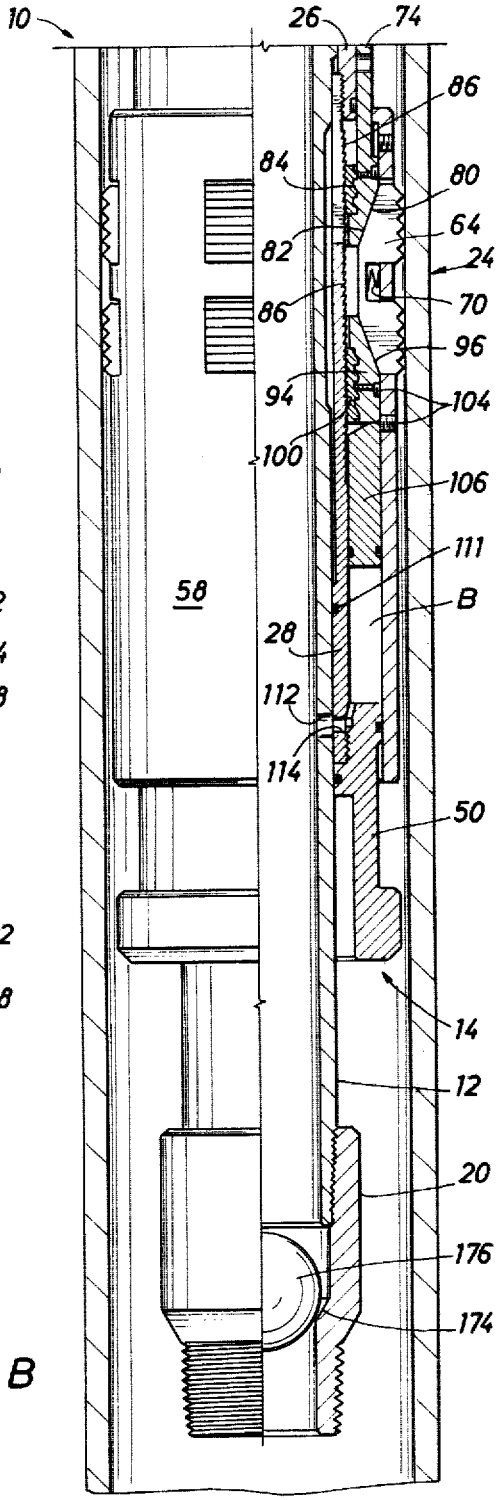
FIG. 4B

WELL PACKER

BACKGROUND OF THE INVENTION

1. Field of the Invention

The present invention pertains to techniques for sealing cylindrical members to circumscribing conduits. More particularly, the present invention relates to well tools, such as well packers, for selectively sealing a tubing string, for example, to a surrounding well conduit such as provided by casing or well liner.

2. Description of Prior Art

Well packers and other well tools are known for selectively sealing and/or anchoring a tubing string, for example, to a surrounding well conduit or liner. Such well tools may be set in the sealing/anchoring configuration by manipulation of a tubing string from which the tools are suspended, or by application of hydraulic pressure by means of the tubing string, for example. The tool may be released from its set configuration and retrieved from the well by appropriate manipulation of the tubing string.

Anchoring devices are known to include a plurality of slip members with opposed camming surfaces which cooperate with complementary opposed frustoconical wedging surfaces, for example, whereby the slip members are extendable radially into gripping engagement with the well conduit in response to relative axial movement of the wedging surfaces. Sealing devices are known which include annular resilient seal members which expand radially into sealing engagement with the well conduit in conjunction with axial compression of the sealing members. Thus, such packers may be set, rendering the sealing mechanism and the anchoring mechanism both in appropriate engagement with the surrounding well conduit, in response to relative longitudinal movements of various packer components, effected either hydraulically or mechanically.

A well packer may be locked in its set configuration, and permit variation of the well pressures and/or manipulation of the tubing string without unsetting the packer. Packers of various designs may be retrieved from the well by appropriate manipulation of the tubing string, for example. In some instances, the packer may be released from its set configuration by a straight pull upwardly on the tubing string. Pressure-responsive clamping or holding devices are known for preventing unwanted longitudinal movement of the tubing string which might otherwise release the packer prematurely. Such longitudinal tubing string movement may be urged, for example, in response to a variation in tubing string length due to temperature variations, or an increase in down-hole fluid pressure acting upwardly on the tubing string.

While packer anchoring devices utilizing opposed wedging systems may resist disengagement urged by pressure differentials acting on the packers either upwardly or downwardly, where the packer sealing mechanism and anchoring mechanism are fixed in set configuration by a common locking device, any slippage in the packer components in response to forces acting to unset the anchoring mechanism might dislodge, or interrupt the sealing engagement between the packer and the surrounding well conduit. Once the integrity of the sealing engagement of the packer is thus destroyed, it may difficult or impossible to regain the sealed connection between the tubing string and the conduit. It is therefore desirable to provide a well tool which may be set and locked in sealing engagement with a surrounding well conduit independently of the setting and locking of the anchoring engagement of the well tool to the conduit.

SUMMARY OF THE INVENTION

Apparatus according to the present invention includes first and second means for engaging a conduit circumscribing the apparatus, each of the first and second engaging means being movable from a first postion of nonengagement to a second position for engaging the conduit. The first engaging means is operable independently of operation of the second engaging means whereby the first engaging means may be moved to the engaging configuration, locked in the engaging configuration and released from the engaging configuration independently of like operations of the second engaging means.

In particular, the first engaging means of the present invention may include sealing means being movable between a first configuration, in which the sealing means is not in sealing engagement with the conduit, and a second configuration in which the sealing means so sealingly engages the conduit. The second engaging means may include anchoring means being movable between a first position, in which the anchoring means is not in gripping engagement with the conduit, and a second position in which the anchoring means grippingly engages the conduit to anchor the apparatus to the conduit. The invention further provides setting means for so moving the sealing means into the second configuration, and for so moving the anchoring means into the second position. The sealing means may be locked in the first configuration in sealing engagement with the conduit by first locking means; the anchoring means may be locked in the second position in anchoring engagement with the conduit by second locking means.

The sealing means may comprise one or more resilient annular seal members, expandable radially to the second configuration upon axial compression of the seal members by the setting means. The anchoring means may comprise a plurality of slip members, and the setting means may comprise wedge members, movable axially relative to the slip members. The wedge members cooperate with cam surfaces connected to the slip members to effect radial movement of the slip members into the second position upon such relative axial movement by the wedge members.

The setting means may further comprise piston means responsive to fluid pressure for effecting the axial compression of the seal members, and responsive to fluid pressure to so move the wedge members axially. The first locking means may comprise slip means for locking the seal members in the second configuration and the second locking means may comprise slip means for locking the wedge means against axial movement once the slip members have been propelled into the second position. Further, the slip means of the first locking means may be operated to so lock the seal members in the second configuration independently of the slip means of the second locking means.

The invention further includes release means for releasing the slip means of the first and second locking means from locking the seal members and the anchoring means, respectively, in engagement with the conduit. Pressure responsive means may be provided for holding the release means, with increasing force, fixed against unlocking the sealing means and the anchoring means in response to forces tending to so operate the release means.

The present invention is illustrated in a well tool, including a well packer to be releasably set internally of a well conduit. The packer includes a mandrel generally circumscribed by an outer packer assembly. The outer assembly includes seal means, for selective radial extension into sealing engagement with the conduit, anchoring means, for selective radial extension into anchoring engagement with the conduit, and setting means for so selectively propelling the seal means and the anchoring means radially into respective engagements with the conduit. The seal means may be mounted on sleeve means, which may include first and second sleeve members releasably connected together. First lock means, including slip means, may be provided for engagement with the sleeve means to lock the seal means in extended configuration in sealing engagement with the well conduit. Second lock means, including slip means, may be selectively engagable with the second sleeve member for locking the anchoring means radially extended in gripping engagement with the conduit. The connection between the first and second sleeve members may be released upon longitudinal movement of the mandrel relative to the outer assembly.

A holding system is provided for releasably connecting the mandrel to the outer assembly against relative axial movement between these two elements. The holding system may be released either by straight longitudinal movement of the mandrel relative to the outer assembly, or by rotation of the mandrel to unthread the mandrel from the outer assembly. The holding system includes latch dogs mounted on a collet assembly, and movable between a locking configuration for connecting the mandrel to the outer assembly and a release configuration wherein the mandrel is released for longitudinal movement relative to the outer assembly. The holding system also includes pressure compensation means in the form of a piston for holding the latch dogs in the locking configuration with force which increases in response to fluid pressure which tends to move the mandrel longitudinally relative to the outer assembly.

The present invention provides a tool, such as a well packer, for releasable setting within a surrounding conduit such that the packer may be both sealed and anchored to such a conduit. The sealing mechanism may be both set and locked in the conduit-engaging configuration independently of the setting and locking of the anchoring mechanism in gripping engagement with the conduit. Further, the sealing mechanism may be unlocked and released from its sealing engagement with the conduit independently of the unlocking and release of the anchoring mechanism from its set configuration. The full force used to set the sealing mechanism in engagement with the conduit, or applied to the sealing mechanism during other pressure operations, is maintained holding the sealing mechanism in such engagement. Consequently, any tendency of the packer to be prematurely and/or inadvertently moved out of anchoring engagement with the well conduit, such as due to slacking in the locking of the anchoring system, or to motion of the tubing string due to temperature-induced shrinking, for example, does not dislodge or loosen the sealing engagement of the packer with the conduit.

The packer may by hydraulically set and locked in its set configuration in stages. Similarly, by appropriate longitudinal movement of the tubing string, the packer may be released from its set configuration in stages, and withdrawn from the well with the tubing string. The inadvertent, premature release of the packer from its set configuration is prevented by operation of a hold-down system by which longitudinal movement of the tubing string relative to the outer packer assembly is prevented. A pressure compensation system responds to well fluid pressure tending to raise the tubing string by locking the collet-mounted dogs of the hold-down system with forces which increase as the fluid pressure tending to move the tubing string increases. The hold-down system may be released either by rotation of the tubing string relative to the outer packer assembly, or by an initial straight pull of the tubing string.

BRIEF DESCRIPTION OF THE DRAWINGS

FIGS. 3A and 3B similarly illustrate the well packer of FIGS. 2A and 2B, but with the slip segments of the packer partially anchored against the surrounding well casing;

FIGS. 4A and 4B are views similar to FIGS. 3A and 3B, but illustrate the packer in its fully set configuration;

DESCRIPTION OF PREFERRED EMBODIMENT

Figure 1A:
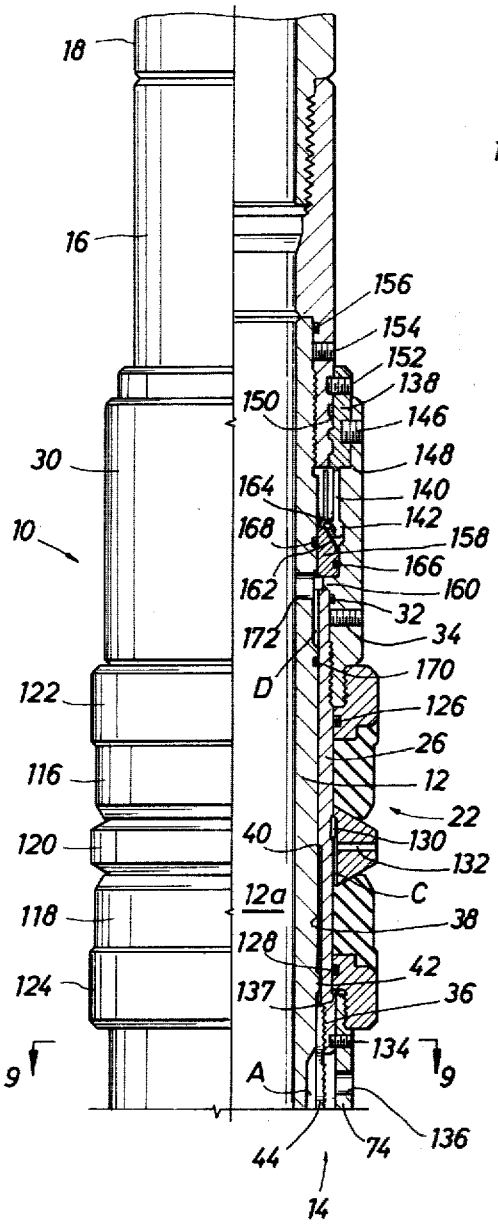
FIGS. 1A and 1B combined provide an elevation in quarter section of a well packer according to the present invention in configuration to be run in a well conduit, FIG. 1A illustrating the upper portion of the apparatus and FIG. 1B illustrating the lower portion.
Figure 1B:
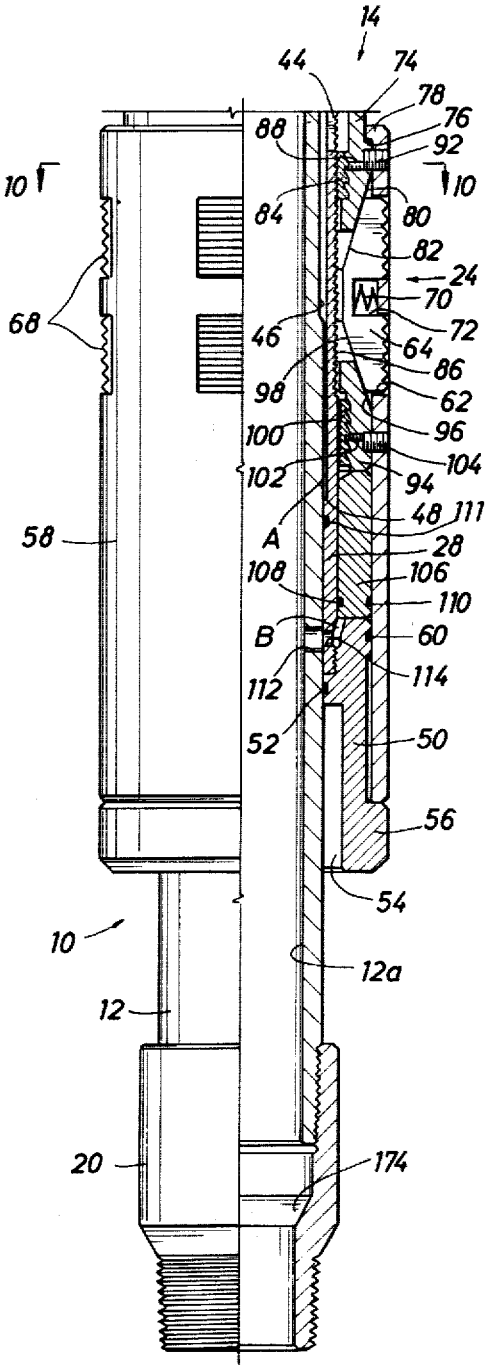

Apparatus according to the present invention, in the form of a well packer, is shown generally at 10 in FIGS. 1A and 1B combined. The packer 10 includes a central, tubular mandrel 12 featuring a generally cylindrical central passage 12*a*. The mandrel 12 is generally circumscribed by an outer assembly 14 of the packer 10, and is connected thereto by means of a collar 16, as discussed more fully hereinafter. The packer 10 is joined to a tubing string 18 by means of the collar 16. The tubing string 18, which may be a well production string for example, may be continued below the packer by means of additional tubing elements extending downwardly from the bottom of the mandrel 12. A landing collar 20, whose structure and function is discussed in further detail hereinafter, is threadedly connected to the bottom of the mandrel and may in turn support additional elements of the tubing string 18. The central passage 12*a* of the mandrel 12, as well as that of the collar 16, is concentric with and forms a continuation of the tubular bore of the tubing string 18.

The outer packer assembly 14 includes a seal assembly 22 and an anchoring assembly 24, both radially extendable as described hereinafter to engage a surrounding conduit.

Figure 6A:
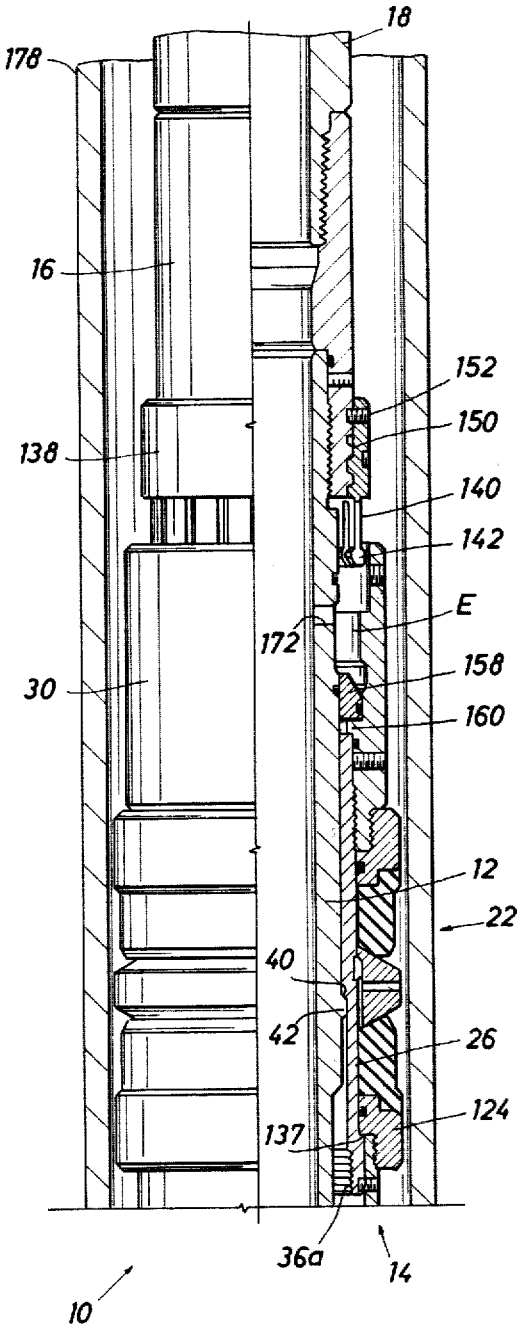
FIGS. 6A and 6B combined are similar to FIGS. 5A and 5B combined, but illustrate the slip segments partially released.

The outer assembly 14 also includes a sleeve system comprising an upper, or first, sleeve member 26 and a lower, or second, sleeve member 28. The upper sleeve member 26 is sealed to a connector housing 30 by an O-ring seal 32 residing in an appropriate groove, and is anchored to the housing by a threaded connection that is locked by a set screw 34. The bottom of the upper sleeve 26 is threadedly connected to the top of the lower sleeve 28 at 36. The connection 36 is constructed of coarse threads 36*a* and 36*b* (FIGS. 6A and 6B) on the sleeve members 26 and 28, with the lower sleeve member 28 positioned internally of the upper sleeve member 26 and defining the lower limit of a recess 38 formed by undercutting the internal surface of the upper sleeve member. The upper limit of the recess 38 is defined by an annular shoulder 40 on the upper sleeve member 26. An annular flange, or shoulder, 42 of the mandrel 12 is confined within the recess 38, as illustrated in FIG. 1A. Above the shoulder 40, the upper sleeve member 26 fits relatively closely against the outer surface of the mandrel 12. Similarly, below the shoulder 42, the upper end of the lower sleeve member 28 fits relatively closely against the outer surface of the mandrel 12 in the configuration of FIGS. 1A and 1B.

The lower sleeve member 28 is constructed in the form of a collet assembly, with the upper portion of the sleeve member comprising upwardly-extending collet fingers 44. The threaded connection 36 between the sleeve members 26 and 28 is located at the upper end of the collet fingers 44. The mandrel 12 features an annular recess 46 begining a short distance below the shoulder 42 and extending downwardly. In the configuration of FIGS. 1A and 1B, the recess 46 is positioned below the location of the connection 36. As discussed in greater detail hereinafter, the radial depth of the recess 46 is sufficient so that, when the recess 46 is in registration with the connection 36, the collet fingers 44 may be strained radially inwardly into the recess 46 to permit the threaded connection 36 to disengage. However, with the threaded connection 36 positioned above the recess 46 as illustrated, the collet fingers 44 are held by the mandrel 12 against straining radially inwardly, and the connection 36 between the sleeve members 26 and 28 remains intact.

The lower end of the second sleeve member 28 extends inwardly to establish a length of the sleeve of reduced internal diameter that fits relatively closely against the mandrel 12, defined at its upper limit by the annular shoulder 48. Consequently, an elongate annular region A of varing thickness is established between the mandrel 12 and the lower sleeve member 28, and generally defined at the axial ends of the region by the sleeve shoulder 48 and the upper end of the mandrel recess 46. As will be appreciated by the discussion hereinafter, however, the definition of the region A varies with the configuration of the packer 10.

The lower sleeve member 28 is threadly connected to a retaining skirt 50, which is sealed to the mandrel 12 by an O-ring seal 52 carried in an appropriate groove. The retaining skirt 50 features an annular undercut region 54, for a purpose discussed hereinafter, and an outwardly extending shoulder 56. A generally tubular slip cage 58 rests on the shoulder 56 in the configuration of FIG. 1B. The shoulder 56 thus serves to lend support to the slip cage 58 as the packer 10 is run in a well in the configuration of FIGS. 1A and 1B, and serves to guard the slip cage from catching on obstructions, which may be found at casing segment connections for example, which might otherwise tend to inadvertently drive the slip cage upwardly relative to the mandrel 12 to prematurely set the packer 10 during the run-in procedure. The retaining skirt 50 is sealed to the internal surface of the slip cage 58 by an O-ring seal 60 carried in an appropriate groove.

The slip cage 58 features windows 62 which accommodate a plurality of slip members 64 of the slip assembly 24. While the number of slip members 64 may be varied, and the slip cage 58 provided with an appropriate corresponding number of windows 62, four slip members are indicated as part of the packer 10. Each of the slip members 64 features upper and lower gripping surfaces 68 positioned to extend radially through individual windows 62 in the slip cage 58. Two windows 62 are provided axially displaced for each slip member 64, with the wall of the slip cage 58 between the paired windows serving to confine a conical coil spring 70 which resides in a recess 72 of the corresponding slip member. The conical springs 70 bias the slip members 64 radially inwardly relative to the wall of the slip cage 58, and thus serve to maintain the gripping surfaces 68 retracted in the absence of forces propelling the slip members radially outwardly. Each of the gripping surfaces 68 is constructed of horizontally-oriented gripping edges which provide gripping contact in both senses of the longitudinal direction of the packer 10. The gripping surfaces 68, including the horizontal gripping edges, are curved to generally follow the cylindrical internal surface construction of well casing with which the slip members 64 may engage.

An upper tubular spreader cone assembly 74 extends downwardly into the top of the slip cage 58, and features an annular shoulder 76 which fits under an inwardly-directed flange, or shoulder, 78 of the slip cage, the two shoulders 76 and 78 defining the limit of axial movement of the cone assembly upwardly relative to the slip cage. A downwardly facing, frustoconical wedging surface 80 of the cone assembly 74 is generally complementary to upwardly-facing, slanted upper can surfaces 82 of the slip members 64.

A split ring locking slip 84 is positioned internally of the cone assembly 74 and connected thereto by coarse, downwardly-facing buttress threads on the ring slip meshed with matching upwardly-facing buttress threads on the cone assembly. The exterior surface of the lower sleeve member 28, including the collet fingers 44 below the threaded connection 36, features upwardly-facing buttress threads 86 whose pitch is relatively small compared to the pitch of the coarse threads connecting the ring 84 with the cone assembly 74. The interior surface of the ring slip 84 is lined with small pitch, downwardly-facing buttress threads to mesh with the threads 86 of the lower sleeve member 28. A set screw 88 extends radially through the cone assembly 74 and resides in an appropriate bore 90 (FIG. 10) in the ring slip 84 to prevent rotational movement between the ring slip and the cone assembly which might otherwise inadvertently mutually disengage these two elements. One or more shear screws 92 (one shown) releasably anchors the cone assembly 74 to the slip cage 58.

Figure 10:
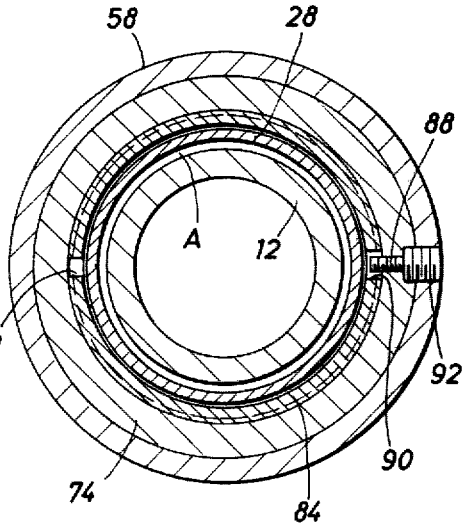
FIG. 10 is an enlarged transverse cross section taken along line 10—10 of FIG. 1B.

Details of the structure and positioning of the ring slip 84 may be appreciated by reference to FIGS. 1B and 10. A split 84*a* in the ring 84 (FIG. 10), as well as the loose fit of the ring within the threads of the cone assembly 74, permits sufficient radial expansion of the ring to allow the ring to ratchet upwardly over the threads 86 of the sleeve member 28 upon axial movement of the ring upwardly relative to the sleeve. However, due to the orientation of the threads 86 and the matching buttress threads on the internal surface of the split ring 84, downward movement of the ring slip 84 relative to the sleeve member 28 is prevented by the meshing of the threaded connection between these two elements.

Upward movement by the upper cone assembly 74 drives the ring slip 84 to so ratchet up the sleeve member threads 86 due to the buttress thread connection between the cone assembly and the ring slip. However, that same buttress thread connection merely wedges the ring slip 84 radially into tighter anchoring engagement with the lower sleeve member 28 in response to any tendency of the upper cone assembly 74 to move downwardly. Consequently, once the cone assembly 74 is driven upwardly along the sleeve member 28, the cone assembly is locked against downward movement relative to the lower sleeve member.

A lower spreader cone 94 is positioned within the slip cage 58 and features and upwardly-facing frusto-conical wedging surface 96 generally complementary to downwardly-facing cam surfaces 98 on the slip members 64. A split ring locking slip 100 is positioned internally of the lower cone 94 and connected thereto by coarse, downwardly-facing buttress threads on the exterior of the slip 100 meshed with matching upwardly-facing buttress threads on the interior surface of the spreader cone 94. A set screw 102 is engaged in an appropriately threaded bore in the spreader cone 94 and extends into an appropriate bore in the ring slip 100 to prevent inadvertent rotational movement between these two elements, which might otherwise result in their mutual disengagement, in the same manner that the set screw 88 locks the upper ring slip 84 to the upper cone assembly 74. One or more shear screws 104 (one shown) releasably anchors the lower cone 94 to the slip cage 58.

The construction and function of the ring slip 100 in relation to the lower cone 94 is similar to the construction and function of the ring slip 84 in relation to the upper cone assembly 74. The interior surface of the ring slip 100 features downwardly-facing buttress threads matching and meshing with the threads 86 of the lower sleeve member 28. The construction of the ring slip 100 and its mounting within the lower cone 94 allows the ring slip to ratchet upwardly over the threads 86 of the lower sleeve member 28, but downward movement of the ring slip 100 relative to the sleeve member is prevented by the meshing of the sleeve threads 86 with those of the interior surface of the ring slip 100.

The lower cone 94 may be propelled upwardly to cause the ring slip 100 to ratchet upwardly along the lower sleeve member threads 86 due to the buttress thread connection between the cone 94 and the ring slip 100. The locking of the ring slip 100 against downward movement relative to the sleeve member 28 prevents downward movement of the cone 94 relative to the sleeve member 28 since such downward movement by the cone would cause the buttress thread connection between the cone and the ring slip to wedge the ring slip even tighter into meshing engagement with the threads 86 of the sleeve member 28. Consequently, as in the case of the upper cone assembly 74, once the lower cone 94 is driven upwardly along the sleeve member 28, the lower cone is locked against downward movement relative to the lower sleeve member.

An annular, floating setting piston 106 circumscribes the lower sleeve member 28 and lies within the slip cage 58 between the top of the retaining skirt 50 and the bottom of the lower cone 94. O-ring seals 108 and 110, carried in appropriate annular grooves in the piston 106, seal the piston to the sleeve member 28 and the slip cage 58, respectively. An O-ring seal 111, carried in an appropriate annular groove, seals the sleeve member 28 to the mandrel 12. A pressure chamber B is thus formed between the piston 106 and the retainer skirt 50 and radially between the slip cage 58 and the lower sleeve member 28, defined by the seals 52, 60, 108, 110 and 111. Access to the pressure chamber B from the bore 12*a* of the mandrel 12 is provided by one or more radial ports 112 (one shown) through the mandrel and one or more radial ports 114 (one shown) through the lower sleeve member 28. The function of the pressure chamber B is discussed in detail hereinafter.

The seal assembly 22 includes two annular resilient seal members 116 and 118 mounted on the upper sleeve member 26 and axially separated by a seal spacer 120. The seal members 116 and 118 are positioned axially between an upper seal retainer ring 122 and a lower seal compression ring 124. The rings 122 and 124 are sealed to the sleeve member 26 by O-rings 126 and 128, respectively, carried in appropriate grooves in the rings. The spacer 120 is fixed against axially downward movement relative to the sleeve member 26 by a snap ring 130 residing in an appropriate annular groove in the sleeve member 26, but may be moved upwardly against the upper seal member 116. An annular space C underlies a portion of the spacer 120, and communicates with the area external to the spacer by at least one radial throughbore 132. The shapes of the rings 122 and 124, and the shape of the spacer 120 where these elements contact the seal members 116 and 118 are provided to enhance the radial extension of the seal members upon axial compression of the seal members occasioned by the upward axial propulsion of the compression ring 124 as described. The spacing C and the throughbores 132 cooperate to prevent a pressure lock that might impede the axial movement of the spacer 120 upon such compression, or relaxation, of the seal members 116 and 118. However, the shape, number and method of mounting of the seal members and the ancillary elements, such as the rings and spacer, included in the seal assembly 22 may be varied as known in the art while still providing a seal assembly that may expand radially, for example to selectively engage a conduit surrounding the packer 10.

Figure 9:
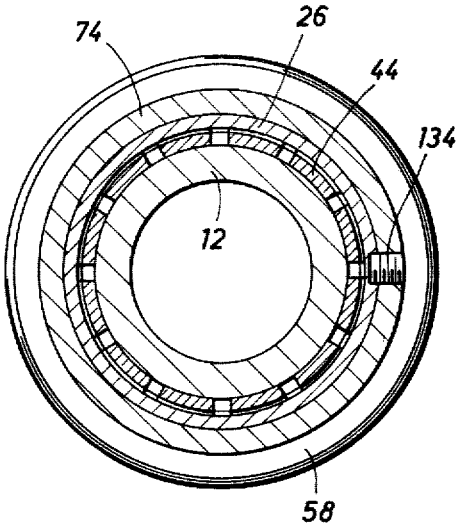
FIG. 9 is an enlarged transverse cross section taken along line 9—9 of FIG. 1A.

The seal retainer ring 122 is threadedly joined to the housing 30 and, thereby, fixed relative to the upper sleeve member 26. The upper cone assembly 74 is threadedly engaged to the compression ring 124. One or more shear screws 134 (one shown) releasably anchors the upper cone assembly 74 to the upper sleeve member 26 (FIGS. 1A and 9). The cone assembly 74 also features one or more radial ports 136 (one shown) to allow fluid flow therethrough to facilitate movement of the packer 10 along a conduit filled with well fluid, for example. An annular shoulder 137 on the upper sleeve member 26 extends radially below the compression ring 124, and raises the ring 124 and other components of the outer assembly 14 supported thereby in the packer release configuration, as described hereinafter.

The housing 30 partially encloses, and forms part of, a hold-down system for releasably anchoring the mandrel 12 to the outer assembly 14 and which includes an anchoring collet assembly 138 featuring downwardly-extending collet fingers 140. Each collet finger 140 ends in an enlarged dog or latch element 142 which, in the relaxed state of the collet fingers 140, may reside in an annular groove 144 of the housing. The collet assembly 138 is releasably locked to the housing 30 by at least one shear screw 146. Additionally, complementary shoulders of the collet assembly 138 and the housing 30 abut at 148 to prevent upward axial movement of the housing relative to the collet assembly.

The collet assembly 138 is threadedly connected to the collar 16 by means of matching, meshed large pitch threads 150, and at least one shear screw 152.

The threaded connection between the mandrel 12 and the collar 16 is locked by a set screw 154, and the mandrel is sealed to the collar by an O-ring seal 156 carried in an appropriate groove.

An annular floating piston 158 is confined between the mandrel 12 and the housing 30, and is limited in its downward axial movement by an inwardly-extending annular shoulder 160 of the housing. Upward axial movement of the piston 158 relative to the housing 30 is generally limited by the dogs 142 of the collet assembly 138. In particular, with the dogs 142 residing in the housing groove 144, an upwardly-facing frustoconical surface 162 of the piston may engage complementary downwardly-facing cam surfaces 164 of the dogs. Upward propulsion of the piston 138 against the dogs 142 residing in the groove 144 thus wedges the dogs tightly in the groove by the cooperative contact of the slanted piston and dog surfaces 162 and 164, respectively.

The piston 158 is sealed to the housing by an O-ring seal 166 carried in an appropriate annular groove in the piston. An O-ring seal 168 carried in an appropriate annular groove in the mandrel 12 seals the piston 158 to the mandrel when the piston is in registration with the seal 168. An O-ring seal 170 is carried in an appropriate annular groove in the radially extended surface of the mandrel 12 to seal the mandrel to the upper sleeve member 26 in the configuration of FIGS. 1A and 1B. A pressure chamber D is thus formed between the mandrel 12 and the housing 30, and limited by the seals 32, 166, 168 and 170. Access to the pressure chamber D from the central passage bore **12*a* of the mandrel 12 is provided by one or more radial ports 172 passing through the mandrel wall. The outer diameter of the mandrel 12 between the seals 168 and 170, and about the port 172, is reduced to increase the extent of the pressure chamber D and to facilitate fluid communication between the mandrel bore 12*a*** and the chamber D.

The packer 10 is particularly adapted for use in well conduits, such as well casing or liner strings. Further, the packer 10 may be utilized as a downhole well tool for a variety of purposes, such as sealing a production string to such a well conduit, for example. Whatever the application, the packer 10 may be maneuvered into position in the well, supported by a tubing string 18 and in the running-in configuration illustrated in FIGS. 1A and 1B. Thus, the packer 10 is run-in a well with the seal assembly 22 and the anchoring assembly 24 both retracted, and the shear pins 92, 104 and 134 holding the packer locked in this running-in configuration. The tubing string 18 then serves as a conduit for communicating fluid pressure to the mandrel bore **12*a* to set the packer 10**.

Figure 2A:
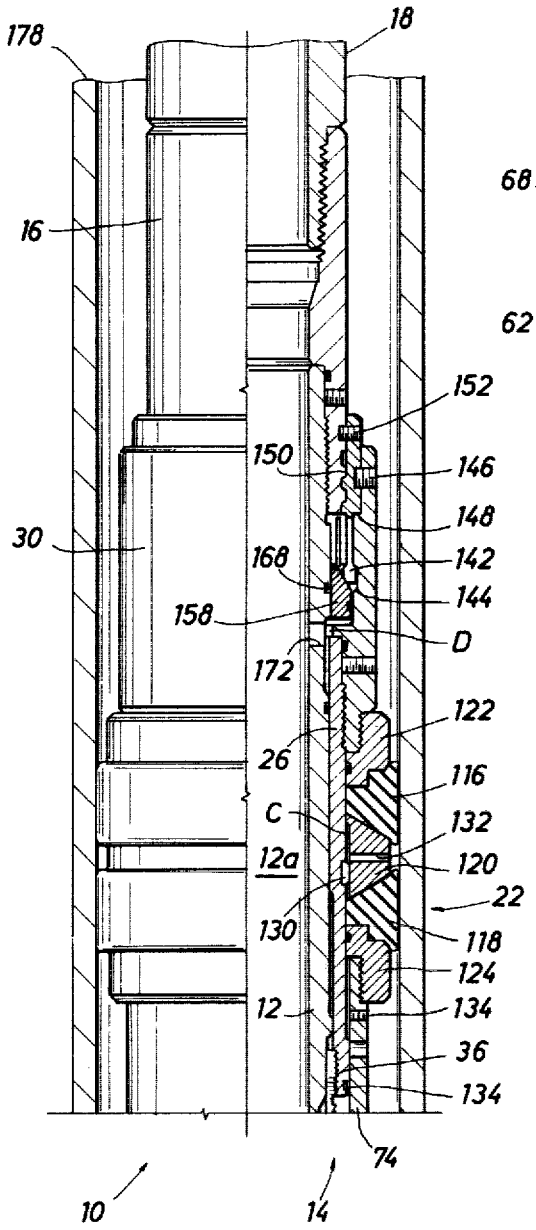
FIGS. 2A and 2B combined are similar to FIGS. 1A and 1B combined, but with the seal assembly of the well packer moved into sealing engagement with a circumscribing casing.
Figure 2B:
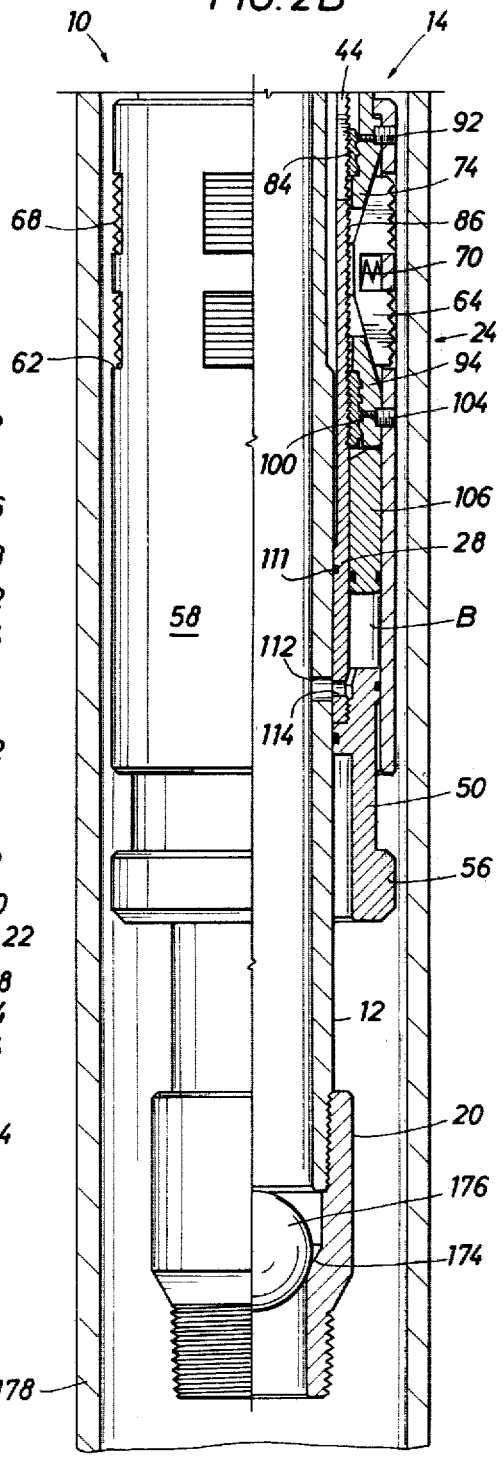

The landing collar 20 includes an internal, upwardly-facing frustoconical seating surface 174 designed to receive and seal to a plugging device, such as a ball 176 as illustrated in FIG. 2B, which may be dropped in place through the tubing string 18 and mandrel 12 after the packer 10 is positioned in the well. The packer 10 may then be set by fluid pressure applied through the mandrel bore **12*a* to the pressure chamber B, with the ball 176 blocking the rest of the tubing string below the packer 10. Such application of fluid pressure in the pressure chamber B propels the setting piston 106 upwardly relative to the mandrel 12, which action may then effect a sequence of steps causing the packer 10 to be set generally in stages, and to be locked in the various set configuration stages. The setting of the packer 10 may thus include moving the seal assembly 22 from the retracted configuration illustrated in FIG. 1A to an extended configuration in which the seal members 116 and 118 engage and seal to a surrounding well conduit. Setting of the packer may also include moving the slip members 64 of the anchoring assembly 22 from the retracted position illustrated in FIG. 1B to an extended position in which the slip members grippingly engage a surrounding well conduit to anchor the well packer 10 thereto. The seal assembly 22 may be locked in its set configuration regardless of the condition of the anchoring assembly 24. The anchoring assembly 24** may be locked in its set configuration as well.

Both the seal assembly 22 and the anchoring assembly 24 may be released from their respective set configurations by axial movement of the tubing string 18 relative to the outer packer assembly 14. To permit such relative movement of the tubing string 18 the hold-down system connecting the mandrel 12 to the outer packer assembly 14 must be disengaged. As described in detail hereinafter, this disengagement of the mandrel 10 from the outer assembly 14 may be effected generally either by a straight axial pull of the tubing string 18 or by rotation of the tubing string relative to the outer assembly 14. Once released from its set configuration, the entire packer 10 may be moved through the well conduit and retrieved to the surface, for example.

The operation of the packer 10 may be appreciated by reference to FIGS. 2A–8 wherein the packer is illustrated in various stages of being set and released relative to a well conduit 178, which may represent casing or liner for example.

With the packer 10 run in the well conduit 178 in the configuration illustrated in FIGS. 1A and 1B, and the tubing string plugged below the level of the mandrel port 112 by the ball 176 dropped onto the seat 174, for example, fluid pressure may be increased within the mandrel 12 by pumping at the surface to drive the setting piston 106 upwardly against the bottom of the lower cone 94. The forces acting on the piston due to the increased hydraulic pressure in the chamber B are transmitted ultimately to the three shear screws 92, 104 and 134. Thus, the lower cone 94, being urged upwardly by the piston 106, tends to lift the slip cage 58 by the shear screw 104. The slip cage 58 tends to lift the upper cone assembly 74 by the shear screw 92. The upper cone assembly 74 acts through the shear screw 134 to urge the upper sleeve member 26 upwardly. However, the upper sleeve member is locked to the housing 30 which is prevented from upward movement relative to the mandrel 12 and the tubing string 18 by the collet assembly 138 and, specifically, the shoulder abutment at 148 and the threaded connection at 150.

The number and/or size of the shear screws 92, 104 and 134 are preselected to insure that the shear screw 134 breaks in response to smaller forces than are required to break the shear screws 92 and 104. Consequently, as the fluid pressure is applied to the tubing string 18 at the surface to expand the pressure chamber B, the piston 106 raises the anchoring assembly 24, including the slip cage 58, and the upper cone assembly 74 relative to both sleeve members 26 and 28 with the breaking of the shear screw 134. Both ring slips 84 and 100 ratchet upwardly along the sleeve member threads 86 with the respective cones 74 and 94, as described hereinbefore.

The upward movement of the cone assembly 74 drives the compression ring 124 upwardly along the upper sleeve member 26 toward the seal retainer ring 122, which is fixed against axial movement relative to the upper sleeve member as described hereinbefore. Consequently, the seal members 116 and 118 are axially compressed and generally moved toward the retainer ring 122, lifting the spacer 120 axially off of the snap ring 130. As the seal members 116 and 118 are thus compressed axially, they expand radially into engagement with the interior surface of the circumscribing well conduit 178. Sufficient hydraulic pressure may thus be applied in the chamber B to the piston 106 to move the seal members 116 and 118 radially to effect sealing engagement between the packer 10 and the conduit 178.

With the upper seal assembly 74 driven upwardly relative to the sleeve members 26 and 28 and the mandrel 12, the ring slip 84 is ratcheted to an upper position along the threads 86 of the lower sleeve member 28 as illustrated in FIGS. 2A and 2B, and there the ring slip locks the cone assembly 74 against downward movement relative to the sleeve members and the mandrel. Thus, the seal assembly 22 is locked in sealing engagement with the conduit 178, while the anchoring assembly 24 remains generally in its running-in (unset) configuration, although the anchoring assembly has been moved axially relative to the lower sleeve member 28 and the mandrel 12, and is locked in this raised configuration (FIG. 2B) by the ring slips 84 and 100.

The next stage in the process of setting the packer 10 is effected upon further increase in the hydraulic pressure applied through the tubing string 18 and the mandrel 12 to the pressure chamber B, as illustrated in FIGS. 3A and 3B.

The shear screws 92 and 104 are preselected to insure that the shear screw 92 breaks in response to smaller forces than are required to break the shear screw 104. With the upper cone assembly 74 effectively prevented from moving further upwardly relative to the upper sleeve member 26 by the compressed seal members 116 and 118, increased forces acting on the shear screws 92 and 104 due to the increased hydraulic pressure driving the piston 106 upwardly cause the shear screw 92 to break. Then, the slip cage 58 with the slip members 64 held within the windows 62 is driven upwardly relative to the upper slip cone 74. The lower slip cage edges defining the windows 62 lift the respective slip members 64 onto the upper cone assembly 74. The axial movement of the upper camming surfaces 82 along the wedging surface 80 of the cone assembly 74 moves the slip members 64 radially outwardly, compressing the coil springs 70, to protrude through the windows 62 beyond the radial extent of the slip cage 58. As illustrated in FIG. 3B, the gripping surfaces 68 of the slip members 64 are thus moved to extend into gripping engagement with the interior surface of the well conduit 178.

With the slip members 64 thus wedged against the well conduit 178 by the upper cone assembly 74, the packer 10 is effectively hung on the wall conduit by the anchoring assembly 24. Any forces tending to move the packer 10 downwardly relative to the well conduit 178 have the effect of further driving the upper cone assembly 74 under the slip members 64 to wedge the slip members into tighter anchoring engagement with the conduit 178. This is true whether such forces are acting directly on the tubing string and, ultimately, on the seal assembly 22 and the lower sleeve member 28, or are acting directly on the seal members 116 and 118. Additionally, the ring slip 100 locks the lower cone 94 and, through the shear screw 104, the slip cage 58 against downward movement relative to the sleeve members 26 and 28 and the mandrel 12. Thus, in the stage of the setting procedure illustrated in FIGS. 3A and 3B, the slip assembly 24 is partially set, and is locked in this partially-set configuration.

The setting of the packer 10 may be completed upon application of increased hydraulic pressure in the pressure chamber B. With the slip members 64 wedged against the upper cone assembly 74, and the bottom edges of the slip cage windows 62 positioned against the bottom of the slip members, the shear screw 104 will ultimately break upon application of sufficient force on the lower cone 94 by the piston 106, driven upwardly in response to hydraulic pressure. As the cone 94 is further forced upwardly relative to the slip cage 58, the wedging surface 96 interacts with the camming surfaces 98 to wedge the slip members 64 radially outwardly from the bottom. Thus, in the fully set configuration as illustrated in FIGS. 4A and 4B, the slip members 64 are wedged radially outwardly in gripping engagement with the well conduit 178 from both senses of the axial direction.

With the lower cone 94 thus driven upwardly against the slip members 64, the ring slip 100 is also ratcheted upwardly along the lower sleeve member threads 86 to lock the lower cone 94 in its raised position. Thus, the anchoring system 24 is completely set, and locked in its completely set configuration. Any forces acting upwardly on the seal assembly 22 tending to raise the packer 10 will be transmitted through the sleeve members 26 and 28 to the ring slip 100 to tend to raise the lower cone 94, further wedging the lower cone under the slip members 64 which are thus driven into tighter anchoring engagement with the conduit 128. Similarly, forces acting directly on the anchoring system, either the slip cage 58 or the lower cone 94, likewise will effect tighter anchoring engagement of the packer 10 with the conduit 178.

The locking of the packer 10 in set configuration by the ring slips 84 and 100 is releasable, and the packer may be moved out of its set configuration by upward longitudinal movement of the tubing string 18 with the mandrel 12 relative to the outer packer assembly 14, as discussed more fully hereinafter. Such relative longitudinal motion by the tubing string 18 and the mandrel 12 is prevented by the hold-down system, and particularly by the latching of the collet dogs 142 in the housing groove 144 and by the shear screw 146 locking the collet assembly 138 to the housing 30, until the hold-down system is intentionally released. Fluid pressure generated by well fluids, for example, tending to raise the tubing string 18 and the mandrel communicates through the mandrel port 172 to the pressure chamber D, and thereby drives the piston 158 upwardly into locking contact with the dogs 142, with the frustoconical piston surface 162 wedged against the dog cam surfaces 164. Thus, fluid pressure tending to prematurely move the mandrel 12 also increases the forces by which the collet dogs 142 are held in the groove to prevent such unwanted movement of the mandrel.

Similarly, the shear screw 152 is sufficiently strong to prevent inadvertent relative rotational movement between the tubing string 18 and the outer assembly 14, which might otherwise disengage the threaded connection 150, which also secures the packer in set configuration as part of the hold-down system.

With the packer 10 thus completely set, as illustrated in FIGS. 4A and 4B, the mechanism used to plug the tubing string 18 for the setting of the packer may be removed. For example, the ball 176 may be flowed up the tubing string 18 if the packer 10 has been set in a producing well. Otherwise, means may be provided for disposing of the ball 176, or other plugging means, either up or down the well. It will be appreciated that the specific seat 174 and ball 176 combination is illustrated and described herein for purposes of discussion rather than limitation, and may be modified as needed to provide a plugging means so disposable up or down the well. For example, the seat 174 may be part of a separate ring held within the collar 20 by shear screws which will break upon application of hydraulic pressure in the tubing string 18 in excess of that required to set the packer 10. In such case, the seating ring may be sealed to the collar 20 by an O-ring seal, for example. Such a seating device is illustrated in U.S. Pat. No. 3,090,442 which is incorporated herein by reference. U.S. Pat. No. 4,114,694, also incorporated herein by reference, discloses plugging apparatus which may be released upon decrease of fluid pressure within the tubing string. Other plugging devices are known. The particular plugging device utilized with the packer 10 may be selected, for example, as dictated by the circumstances of the well in which the packer is set.

Upon a decrease of the fluid pressure in the tubing string, and removal of the plugging device, the packer 10 remains both anchored and sealed to the surrounding well conduit 178, locked in the set configuration by the ring slips 84 and 100. It will be appreciated, however, that the upper ring slip 84 locks the seal assembly 22 in its extended set configuration in sealing engagement with the surrounding well conduit 178 independently of the locking of the anchoring assembly 24 by the lower ring slip 100. With fluid pressure in the chamber B decreased, the piston 106 may fall to the skirt 50, for example, in the absence of sufficient friction to support the piston.

Figure 5A:
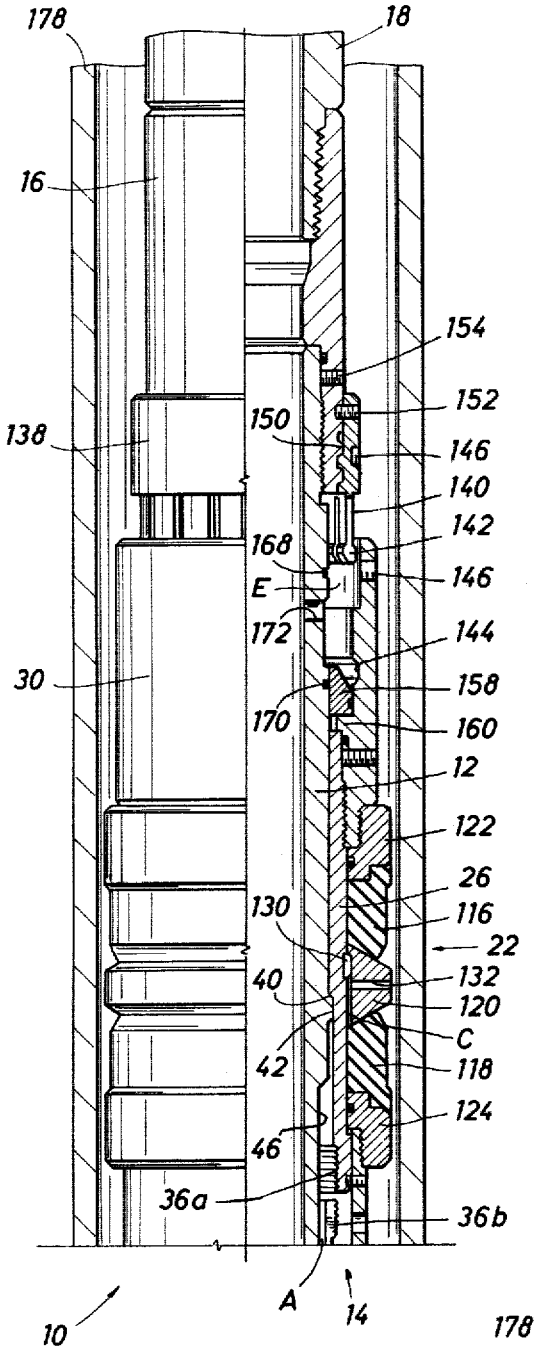
FIGS. 5A and 5B combined illustrate the packer of FIGS. 4A and 4B with the seal assembly released from engagement with the casing by means of a straight pull of the tubing string.
Figure 5B:
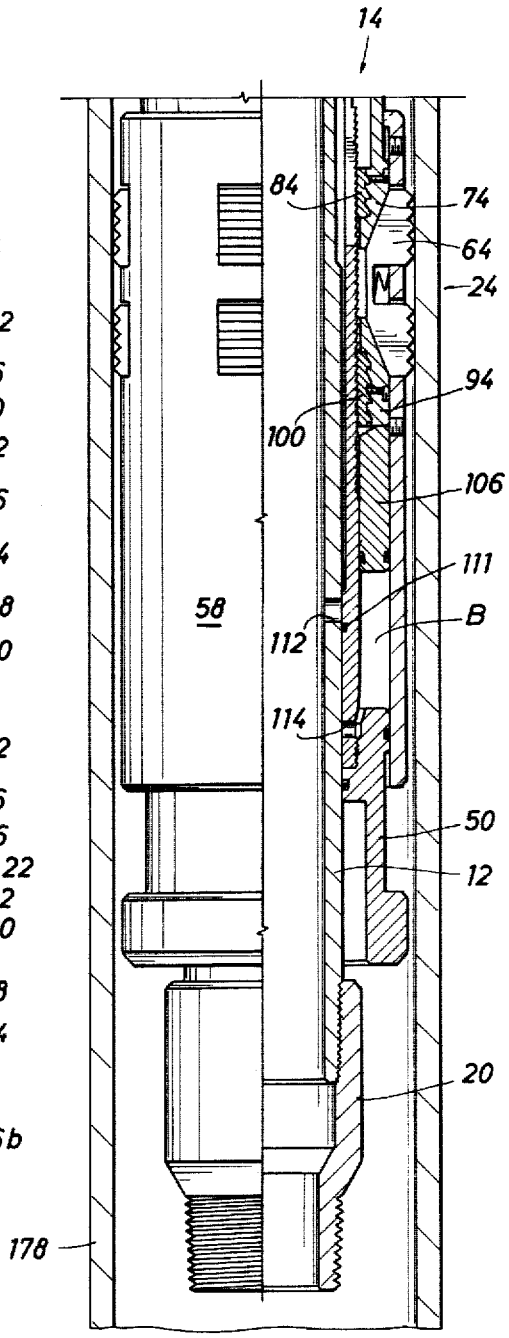

The packer 10 may be released from its set configuration by a straight upward pull on the tubing string 18 to raise the mandrel 12 relative to the outer assembly 14. The hold-down system joining the mandrel 12 to the outer packer assembly 14 must first be unlocked. This may be achieved by either first rotating the tubing string 18, as discussed in detail hereinafter, or by the initial stage of the straight pull on the tubing string, as indicated in FIGS. 5A and 5B.

With the packer 10 in set configuration within the conduit 178, a straight upward pull on the tubing string 18 without initial rotation of the tubing string severs the shear screw 146 as the collet assembly 138 is raised relative to the housing 30. Such upward movement of the collet assembly 138 causes the collet arms 140 to flex radially inwardly as the dogs 142 ride out of the housing groove 144. The length of the collar arms 140 is sufficient, in view of their resiliency, to permit such disengagement of the dogs 142 relative to the groove 144. Further, before the mandrel 12 is moved sufficiently to unlock engagement of the outer assembly 14, the tubing string 18 may be raised sufficiently to allow the dogs 142 to clear the shoulder of the housing 30 which engages in the shoulder abutment 148 with the collet assembly 138.

In order for the dogs 142 to so disengage from the groove 144, the piston 158 must not be held upwardly against the cam surfaces 164 of the dogs by fluid pressure in the chamber D. If such a pressure differential is acting on the piston 158 from below, that is, from within the mandrel 12, sufficient to maintain the dogs 142 locked in the groove 144, the pressure differential may be relieved by appropriate pumping at the surface. Thus, fluid may be pumped into the annular region between the conduit 178 and the tubing string 18 to increase the pressure in that annulus above the set seal assembly 22 and the piston 158. In addition, or alternatively, fluid may be pumped from the interior of the tubing string 18 to lower the pressure within the mandrel bore **12*a* and, therefore, below the piston 158. In any event, with no pressure differential acting upwardly on the piston 158 sufficient to keep the dogs 142 locked in the collar groove 144 to prevent upward movement of the tubing string 18 and the collect assembly 138 relative to the housing 30, the dogs 142 will ride out of the groove to release the hold-down connection between the mandrel 12 and the outer packer assembly 14** as described.

With the dogs 142 free, the tubing string 18 may be further raised to move the mandrel 12 upwardly relative to the outer packer assembly 14 so that the mandrel shoulder 42 engages the shoulder 40 on the upper sleeve member 26. In that configuration, the recess 46 has moved into registration with the threaded connection 36 between the sleeve members 26 and 28. Continued raising of the mandrel 12 forces the upper sleeve member 26 upwardly due to the interaction of the shoulders 40 and 42. However, the lower sleeve member 28 is locked to the anchoring mechanism 24 by the ring slips 84 and 100 and, with the anchoring mechanism, is held against upward movement relative to the well conduit 178. Consequently, as the mandrel 12 urges the upper sleeve member upwardly, the collet arms 44 flex radially inwardly within the recess 46, allowing disengagement of the threaded connection 36 between the upper sleeve member threads **36*a* and the lower sleeve member threads 36*b***.

As the upper sleeve member 26 is raised, the seal retainer ring 122 is lifted relative to the seal members 116 and 118. As the axial compression of the seal members 116 and 118 is released, the seal members relax and expand axially accompanied by radial contraction to disengage from the interior surface of the well conduit 178. As the seal members 116 and 118 reconfigure, the seal spacer 120 is repositioned relatively downwardly against the snap ring 130. The seal assembly 22 is thus released from its set configuration while the anchoring assembly 24 remains locked in its set configuration by the ring slips 84 and 100 held in locking engagement with the lower sleeve member 28.

Continued upward movement of the mandrel 12 raises the shoulder 137 of the upper sleeve member 26 under the compression ring 124. As the compression ring 124 is then raised with the upper sleeve member 26, the upper cone assembly 74 is also raised relative to the lower sleeve member 28 and the slip cage 58. The upward movement of the cone assembly 74 relative to the lower sleeve member 28 causes the ring slip 84 to further ratchet upwardly along the sleeve threads 86. Further, the upper cone assembly 74 is pulled out from under the slip members 64.

Figure 6B:
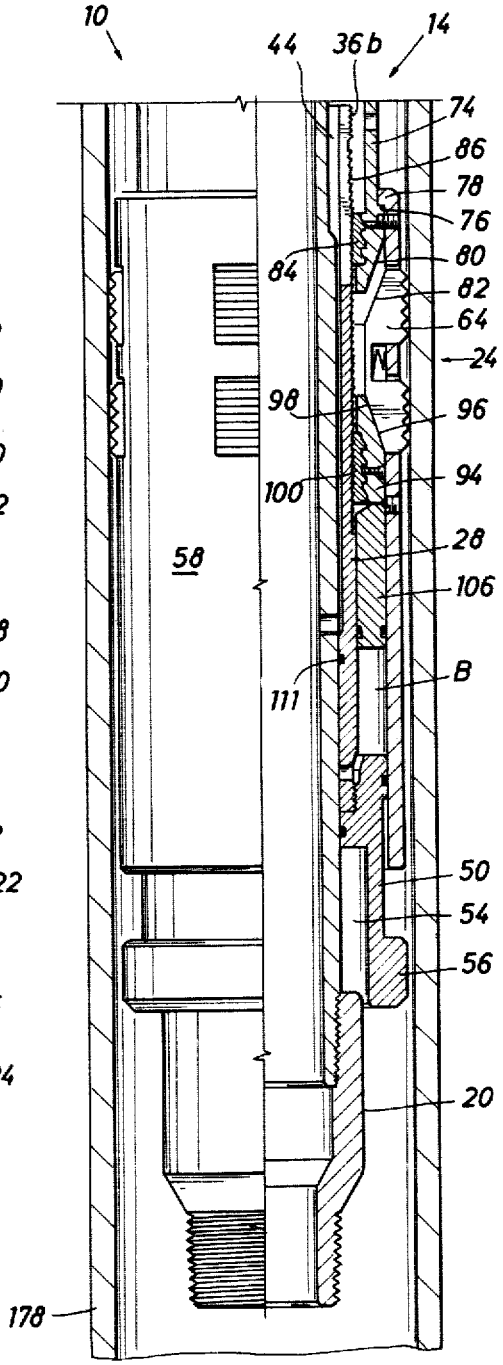

Although the lower sleeve member 28 has been released from the direct threaded engagement 36 with the upper sleeve member 26, the lower sleeve member effectively hangs from the upper sleeve member by the ring slip 84 and the upper cone assembly 74. With the wedge surface 80 of the upper cone assembly 74 out of engagement with the camming surfaces 82 of the slip members 64 as illustrated in FIG. 6B, the anchoring assembly 24 is partially unset. In the configuration of FIG. 6B, the slip cage 58 continues to hang on the slips members 64 by the wedging of the slip members against the well conduit 178 due to the interaction of the slip members camming surfaces 98 with the lower cone wedging surface 96.

Figure 7A:
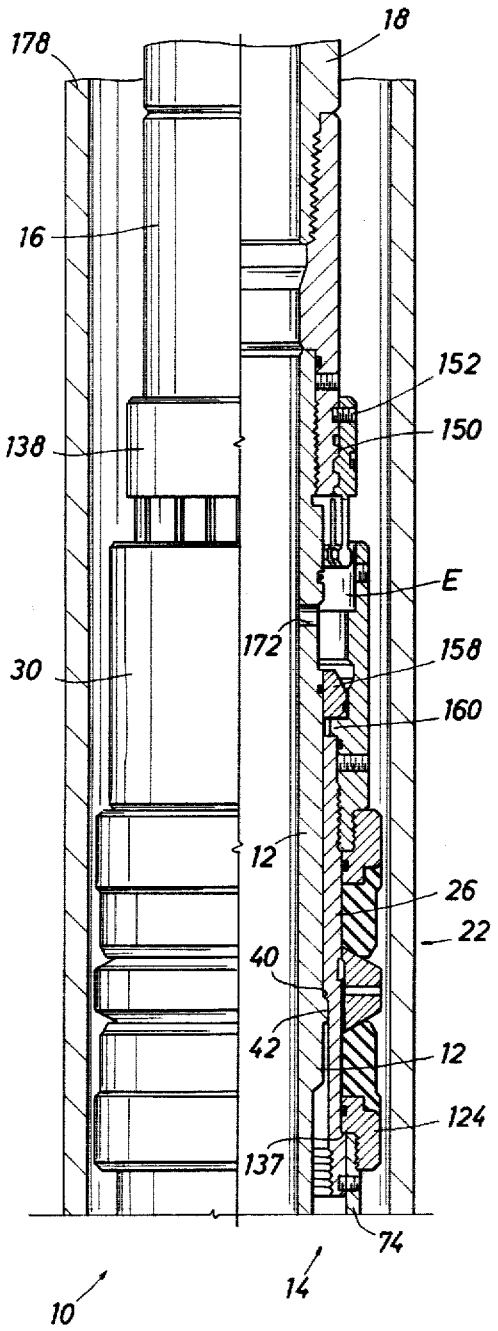
FIGS. 7A and 7B combined are views similar to FIGS. 6A and 6B combined, but with the packer in complete release configuration.
Figure 7B:
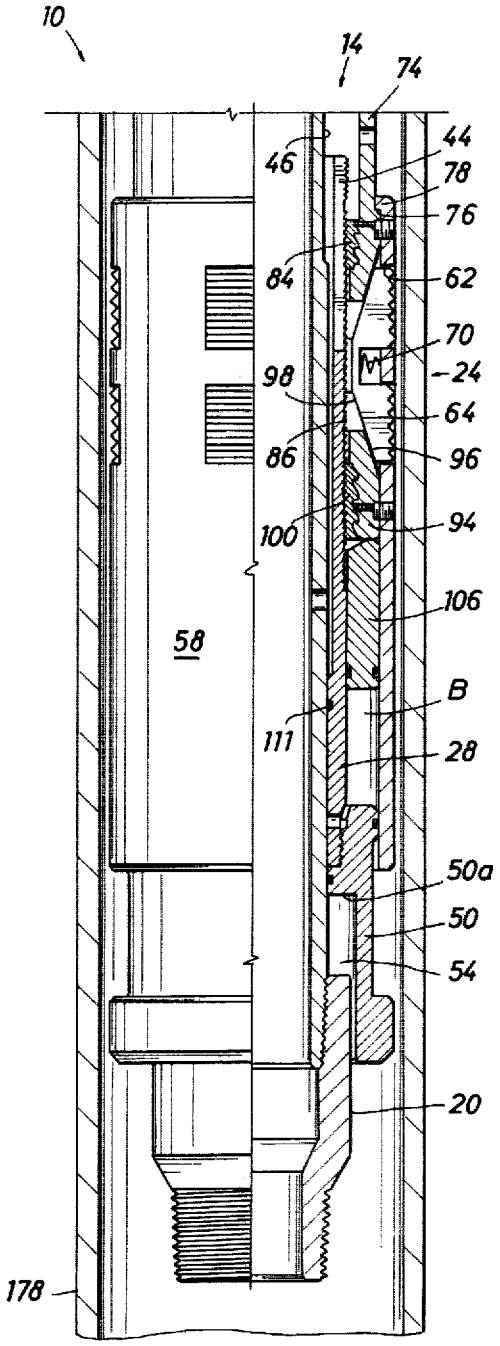

The final phase in the release of the packer 10 is effected by further lifting of the tubing string 18 and the mandrel 12, as illustrated in FIGS. 7A and 7B. As the upper cone assembly 74 continues to rise with the upper sleeve member 26 and the mandrel 12, the cone assembly shoulder 76 engages the slip cage shoulder 78 and lifts the slip cage and, therefore, the slip members 64 relative to the lower cone 94. The camming surfaces 98 disengage from the wedging surface 96. The slip members 64 are thus completely freed of wedging engagement with the well conduit 178, and are retracted radially by expansion of the compressed springs 70. The packer 10 is then completely released from its set configuration in engagement with the conduit 178, and may be withdrawn from the well with the tubing string 18.

As the packer 10 is raised from its position in the well, the outer assembly 14 is generally supported by the mandrel shoulder 42. If there is insufficient friction between the mandrel 12, the lower sleeve member 28, the lower skirt 50, the piston 106 and the slip cage 58, the lower sleeve member and the skirt might fall relative to the mandrel and the slip cage. The piston 106 might also drop relative to the slip cage 58. However, the collar 20 is secured to the mandrel 12 to catch the lower skirt 50 and all parts supported thereby, including the lower sleeve member 28 and the combination of the lower cone 94 and the ring slip 100, as well as the piston 50. Consequently, all packer components may be removed supported ultimately by the tubing string 18.

Figure 8:
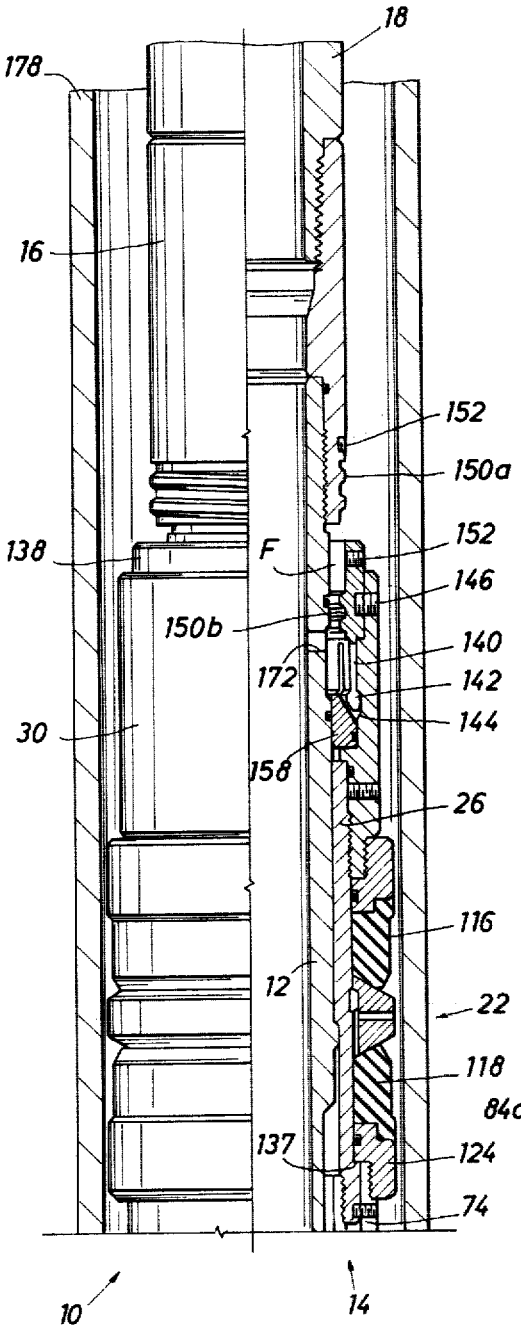
FIG. 8 is a fragmentary elevation of the upper portion of the packer in partial section, showing the packer released by rotation of the tubing string.

The hold-down system joining the mandrel 12 to the outer packer assembly 14 may be unlocked by applying torque to the tubing string 18 at the surface in the right-hand rotational sense. The engagement of the seal assembly 22 and the anchoring assembly 24 with the well conduit 178 provides sufficient friction to prevent rotation of the outer packer assembly 14 with the tubing string 18. Additionally, the shear screw 146 is sufficiently strong to hold the collet assembly 138 fixed against rotational movement as the collar 16 is rotated with the tubing string. However, the shear screw 152 breaks upon application of sufficient torque by the collar 16. Then, as the collar 16 is rotated by means of the operating string 18, the collar threads **150*a* rotate relative to the collet assembly threads 150*b* to effect disengagement of the threaded connection 150 between the collar 16 and the collet assembly 138, as shown in FIG. 8**.

As the tubing string 18 is thus rotated, it may be raised sufficiently to provide the axial advancement of the collar 16 associated with the unthreading of the connection 150. However, it will be appreciated that the longitudinal movement of the mandrel 12 associated with this unlocking of the threaded connection 150 is insufficient to otherwise begin the release process of the set packer 10. Therefore, after the disengagement of the connection 150, the tubing string 18 may be raised by a straight pull to further advance the mandrel 12 to move the mandrel recess 46 into registration with the threaded connection 36 between the sleeve members 26 and 28, and to contact the mandrel shoulder 42 with the sleeve member shoulder 40, as illustrated in FIG. 5A. The remaining process of releasing the packer 10 from its set configuration may then be conducted, with the packer having been unlocked by rotation of the tubing string 18, as in the case of the packer having been unlocked by a straight pull of the tubing string as described hereinbefore.

Regardless of the manner in which the set packer 10 has been unlocked, the pressure chamber D and the piston 158 become ineffective as the mandrel 12 is elevated to raise the O-ring seal 168 out of engagement with the piston, and to position the port 172 above the piston. Further, a flow passage E (FIG. 5A) is established above the piston 158 and external to the collet assembly 138 to communicate with the mandrel central passage **12*a* through the port 172 and the annular region surrounding the tubing string 18 and the packer 10 when the hold-down system is unlocked by a straight pull on the tubing string. If the hold-down system is unlocked by rotation of the tubing string 18, a similar flow passage F (FIG. 8) is established to pass within the collet assembly 138. In either event, as the tubing string 18 and the packer 10 are raised through the well, conduit 178, fluid may pass relatively freely between the interior of the mandrel 12 and the annular region surrounding the packer through the flow passage E or F to facilitate movement of the packer through the well fluid, and to prevent the formation of pressure blocks which might otherwise impede the passage of the packer along the well. Furthermore, the flow passage E or F communicating with the port 172 provides a path by which fluid may be circulated in either direction between the interior and the exterior of the tubing string 18 to remove from the annulus above the packer 10** material, including solid material, which might tend to prevent removal of the packer from the well.

The present invention provides a hydraulically set well packer which may be both set and released in stages, with the packer effectively separately locked and unlocked in each of the stages of setting and release, respectively. In particular, the locking of the seal assembly of the packer in its set configuration is independent of the setting of the anchoring assembly, and of the locking of the anchoring assembly in its set configuration. A hold-down system prevents inadvertent movement of the mandrel necessary to unlock the packer from its set configuration, and includes a pressure responsive device which increases the forces holding the mandrel against such inadvertent movement in response to forces urging the mandrel toward such movement. The pressure responsive device includes a floating piston which locks a collet-mounted dog assembly to secure the connection between the mandrel and the remainder of the packer to insure maintenance of the set configuration of the packer.

The construction and operation of a packer according to the present invention is generally preferred as described and illustrated herein. This is true, for example, if the packer is to be set in circumstances wherein the packer mandrel cannot be moved relative to the packer outer assembly. However, the manner of operation of the packer may be varied. The packer may set, and the seal assembly and the anchoring assembly each locked in set configuration independently as discussed, if the anchoring assembly is set before the seal assembly, for example. Once the anchoring assembly is set hydraulically, the tubing string may be manipulated to lower the packer mandrel to drive the seal assembly downwardly onto the set anchoring assembly to set and lock the seal assembly. Generally, the packer may be set in any order in the absence of some or all of the setting shear screws 92, 104 and 134.

The foregoing disclosure and description of the invention is illustrative and explanatory thereof, and various changes in the method steps as well as in the details of the illustrated apparatus may be made within the scope of the appended claims without departing from the spirit of the invention.

We claim:

1. Apparatus for use in a conduit comprising:

a. sealing means for sealing said apparatus to said conduit by sealing engagement with said conduit, said sealing means being movable between a first configuration, in which said sealing means is not in sealing engagement with said conduit, and a second configuration in which said sealing means so sealingly engages said conduit;

b. anchoring means for selectively anchoring said apparatus to said conduit by gripping engagement with said conduit, said anchoring means being movable between a first position, in which said anchoring means is not in gripping engagement with said conduit, and a second position in which said anchoring means so grippingly engages said conduit;

c. setting means by which said sealing means may be moved into said second configuration for sealing engagement with said conduit, and by which said anchoring means may be moved into said second position for anchoring engagement with said conduit;

d. first locking means by which said sealing means may be locked in said first configuration in sealing engagement with said conduit;

e. second locking means by which said anchoring means may be locked in said second position in anchoring engagement with said conduit; and f. pressure responsive means for increasing forces maintaining said sealing means in said second configuration in response to forces tending to move said sealing means out of said second configuration.

2. A well tool adapted to be set internally of a well conduit comprising:

a. a mandrel generally circumscribed by an outer assembly;

b. sleeve means, as part of said outer assembly;

c. seal means comprising at least one resilient annular seal member, as part of said outer assembly, movable generally radially between a retracted position and an extended configuration in which said seal means sealingly engages said conduit;

d. anchoring means comprising a plurality of slip members, as part of said outer assembly, movable generally radially between a retracted position and an extended position in which said slip members grippingly engage said conduit;

e. setting means, as part of said outer assembly, for selectively moving said seal means from said retracted configuration to said extended configuration, and for selectively moving said anchoring means from said retracted position to said extended position, said setting means comprising wedge means for axial movement relative to said slip members whereby said wedge means cooperate with cam surfaces connected to said slip members so that such relative axial movement between said wedge means and said slip members effects radial movement of said slip members into said second position;

f. first lock means for locking said seal means in said extended configuration;

g. second lock means for locking said anchoring means in said extended position;

h. wherein said first and second lock means operate mutually independently, and any forces acting upwardly on said seal member are transmitted through said sleeve means to said second lock means to tend to raise the wedge means under said anchoring slip member to drive the same into tighter anchoring engagement with the conduit, and any forces acting directly on the anchoring means similarly effect tighter anchoring engagement of the seal member with the conduit.

3. A well tool as defined in claim 2 wherein said first and second lock means may be released to permit said seal means and said anchoring means to move out of the extended configuration and the extended position, respectively, upon axial movement of said mandrel relative to said outer assembly.

4. Apparatus as defined in claim 3 further comprising pressure compensation means, responsive to fluid pressure, for increasing forces by which said mandrel is held against axial movement relative to said outer assembly with said seal means in said extended configuration.

5. A well packer for releasable setting within a well conduit comprising:

a. a central mandrel extending within an outer assembly;

b. holding means comprising latch means mounted on collet means movable between a locking configuration whereby said mandrel is connected to said outer assembly, and a release configuration whereby said mandrel is released for longitudinal movement relative to said outer assembly, said holding means being releasable by longitudinal movement of said mandrel relative to said outer assembly;

c. pressure compensation means, for increasing forces whereby said holding means connects said mandrel to said outer assembly to prevent said longitudinal movement of said mandrel relative to said outer assembly, in response to fluid pressure which tends to so move said mandrel longitudinally, said pressure compensation means comprising piston means for holding said latch means in said locking configuration in response to such fluid pressure with force which increases with said fluid pressure;

d. sleeve means, as part of said outer assembly;

e. seal means mounted on said sleeve means and movable generally radially between a retracted configuration and an extended configuration in which said seal means may sealingly engage said conduit;

f. first lock means engageable with said sleeve means for locking said seal means in said extended configuration;

g. anchoring means, as part of said outer assembly, movable generally between a retracted position and an extended position for grippingly engaging said conduit; and h. second lock means engageable with said sleeve means for locking said anchoring means in said extended position.

6. A well packer for releasable setting within a well conduit comprising:

a. a central mandrel extending within an outer assembly;

b. holding means for releasably connecting said mandrel to said outer assembly against relative axial movement therebetween, said holding means being releasable by rotation of said mandrel relative to said outer assembly;

c. sleeve means, as part of said outer assembly;

d. seal means mounted on said sleeve means and movable generally radially between a retracted configuration and an extended configuration in which said seal means may sealingly engage said conduit;

e. first lock means engageable with said sleeve means for locking said seal means in said extended configuration;

f. anchoring means, as part of said outer assembly, movable generally between a retracted position and an extended position for grippingly engaging said conduit; and g. second lock means engageable with said sleeve means for locking said anchoring means in said extended position.

7. A well packer for releasable setting within a well conduit comprising:

a. a central mandrel extending within an outer assembly;

b. holding means for releasably connecting said mandrel to said outer assembly against relative axial movement therebetween; said holding means being releasable by rotation of said mandrel relative to said outer assembly;

c. sleeve means, as part of said outer assembly;

d. seal means mounted on said sleeve means and movable generally radially between a retracted configuration and an extended configuration in which said seal means may sealingly engage said conduit;

e. first lock means engageable with said sleeve means for locking said seal means in said extended configuration;

f. anchoring means, as part of said outer assembly, movable generally between a retracted position and an extended position for grippingly engaging said conduit;

g. second lock means engageable with said sleeve means for locking said anchoring means in said extended position; and h. pressure compensation means for increasing forces, whereby said holding means connects said mandrel to said outer assembly, in response to fluid pressure.

* * * * *